US007846263B1

(12) United States Patent
Marcantel

(10) Patent No.: US 7,846,263 B1
(45) Date of Patent: Dec. 7, 2010

(54) MOBILE TRASH RECEPTACLE CLEANING SYSTEM AND METHOD

(76) Inventor: Gregory P. Marcantel, 35 N. Bluff Creek Cir., The Woodlands, TX (US) 77382

( * ) Notice: Subject to any disclaimer, the term of this patent is extended or adjusted under 35 U.S.C. 154(b) by 538 days.

(21) Appl. No.: 11/799,419

(22) Filed: May 1, 2007

(51) Int. Cl.
*B08B 3/02* (2006.01)

(52) U.S. Cl. ..... 134/22.1; 134/22.18; 134/52; 134/61; 134/104.2; 134/166 R

(58) Field of Classification Search ..... 134/52, 134/61, 78, 107, 115 R, 123, 166 R, 169 R, 134/8, 18, 22.1, 22.18, 24, 104.2
See application file for complete search history.

(56) References Cited

U.S. PATENT DOCUMENTS

| | | | | | |
|---|---|---|---|---|---|
| 3,203,437 | A | | 8/1965 | Faust | |
| 3,212,511 | A | | 10/1965 | Cuillier | |
| 3,291,144 | A | | 12/1966 | Diamond | |
| 3,324,866 | A | * | 6/1967 | Davis | 134/52 |
| 3,604,038 | A | | 9/1971 | Di Ilio | |
| 3,688,782 | A | * | 9/1972 | Smith | 134/58 R |
| 3,881,950 | A | | 5/1975 | Pettit | |
| 3,901,255 | A | * | 8/1975 | Pettit | 134/107 |
| 4,133,340 | A | * | 1/1979 | Ballard | 134/112 |
| 4,211,745 | A | * | 7/1980 | Boyd | 422/28 |
| 4,242,311 | A | * | 12/1980 | Middaugh | 422/302 |
| 4,694,846 | A | * | 9/1987 | Bouchard | 134/78 |
| 5,964,229 | A | | 10/1999 | Brendel | |
| 6,336,239 | B1 | | 1/2002 | Cooper | |
| 2005/0028254 | A1 | * | 2/2005 | Whiting | 4/213 |
| 2006/0042660 | A1 | * | 3/2006 | Byers | 134/22.1 |

* cited by examiner

*Primary Examiner*—Joseph L Perrin
*Assistant Examiner*—Benjamin Osterhout
(74) *Attorney, Agent, or Firm*—Dan Brown Law Office; Daniel R. Brown

(57) ABSTRACT

A vehicle mountable system for cleaning trash receptacles with wash-water. The system includes an enclosure with an access opening, supported on the vehicle, and a carriage disposed within the enclosure. A spray head is aligned to impinge wash-water against the trash receptacle while it is engaged with the carriage. A basin is aligned to accumulate wash-water drainage from the spraying operation. A spray shield is operated to a closed position that reduces wash-water effluence from the enclosure. The system may include a filter and means for sanitizing wash-water that is accumulated by the basin and recirculated through a holding tank. An automated arm engages a trash receptacle to engage and disengage the trash receptacle with the carriage through the access opening in the enclosure. Plural trash receptacles can be engaged with the carriage and advanced through plural positions within the enclosure. A second spray head aligned to impinge rinse-water against the trash receptacle, and a second basin for accumulating rinse-water drainage may be included in the system. A trash receptacle drying means may also be included within the enclosure.

20 Claims, 8 Drawing Sheets

MOBILE TRASH RECEPTACLE CLEANING SYSTEM AND METHOD

BACKGROUND OF THE INVENTION

1. Field of the Invention

The present invention relates to trash receptacle cleaning. More specifically, the present invention relates to a vehicular mounted system and method for cleaning residential trash collection and recycling receptacles.

2. Description of the Related Art

Trash and recycling receptacles are utilized in virtually every community for the containment and organized collection of trash produced in homes, businesses, and institutions. The types of receptacles are varied, but are generally proportioned in size according to the volume of trash produced by the user as well as the user's ability to physically handle the receptacle. For example, in the case of residential trash collection and recycling, the size and volume of the receptacle is selected to conveniently fit into a garage or storage area of a typical residence, to be manageable in terms of movement to and from the street curb for collection, and to yield a full weight that is not excessively heavy for handling by trash collection personnel. Trash receptacles of various physical configurations are currently in use. The traditional round tin can and lid receptacle is still in use. Many modern trash receptacles are fabricated from plastic, rubber, and polymer materials. Wheels and hinged lids are added to some receptacles for portability and convenience. Many larger communities employ a standardized trash receptacle configuration that is adapted for automated trash collection systems. In such as system, the trash collection vehicle may include and automated collection arm that engages the full trash receptacle, raises and dumps the thrash into the trash collection vehicle, and then returns the empty receptacle to the curb. A similar approach is employed with certain recycling receptacles and recycling vehicles.

Trash and recycling containers are, by definition, unclean. Over time, trash receptacles become dirty. Actually, a better term to describe the state of cleanliness of most trash and recycling receptacles is "filthy." Many users never clean their receptacles. Thus, the filth festers and results in a breeding ground for viruses, germs, insects, vermin, and results in other unsafe conditions. Fastidious users may actually wash their receptacles from time to time. However, such users will have a problem in handling the filthy wastewater that such a cleaning process produces. Typically, that wastewater runs down the gutter into a storm drain. As such, the filth is not properly disposed of, but rather, the filth is simply diverted and can result in a serious environmental pollution issue. Thus, it can be appreciated that there is a need in the art for a system and method of cleaning and sanitizing trash receptacle, which also manages the broader environmental issues associated with the wastewater produced in the cleaning process.

SUMMARY OF THE INVENTION

The need in the art is addressed by the systems and methods of the present invention. The present invention teaches a vehicle mountable system for cleaning trash receptacles with wash-water. The system includes an enclosure with an access opening, supported on the vehicle, and a carriage disposed within the enclosure. A spray head is aligned to impinge wash-water against the trash receptacle while it is engaged with the carriage. A basin is aligned to accumulate wash-water drainage from the spraying operation. A spray shield is operated to a closed position that reduces wash-water effluence from the enclosure.

In a specific embodiment, the foregoing system further includes a means for sanitizing wash-water that is accumulated by the basin. In particular embodiments, the means for sanitizing is a wash-water tank having an ozonation recirculation loop. In another embodiment, the means for sanitizing is a chemical additive. In another specific embodiment of the system, a filter is coupled to remove particulate from the wash-water.

In a specific embodiment, the foregoing system further includes a holding tank for containing a volume of wash-water sufficient for cleaning a plurality of trash receptacles, and a pump that is coupled in a wash-water circuit that consists of the holding tank, the spray head, and the basin, which thereby recirculates the wash-water.

Is a specific embodiment, the foregoing system further includes an automated arm having a first end fixed relative to the enclosure and a second end adapted to engage a trash receptacle. The automated arm further operates to engage and disengage the trash receptacle with the carriage through the access opening in the enclosure. In another specific embodiment, the carriage is configured to engage plural trash receptacles simultaneously. In a refinement to this embodiment, the carriage advances the plural trash receptacles through plural positions within the enclosure.

In a specific embodiment, the foregoing systems further includes a second spray head aligned to impinge rinse-water against the trash receptacle, and a second basin for accumulating rinse-water drainage. In another specific embodiment, the system further includes a trash receptacle drying means disposed within the enclosure.

The present invention also teaches a method of cleaning trash receptacles with wash-water in a vehicle mountable system. The method includes the steps of engaging a trash receptacle with a carriage through an access opening in an enclosure, and operating a spray shield to a closed position thereby reducing wash-water effluence from the enclosure. Then, impinging wash-water against the trash receptacle, and accumulating wash-water drainage in a basin.

In a specific embodiment, the method further includes the step of sanitizing the wash-water accumulated by the basin by using a chemical additive. In another embodiment, the further step of sanitizing the wash-water accumulated by the basin using a wash-water tank having an ozonation recirculation loop. In another specific embodiment, the foregoing method includes the steps of filtering particulate matter from the accumulated wash-water, and recirculating filtered wash-water to the spraying step.

In a specific embodiment, the foregoing method further includes the steps of engaging and disengaging the trash receptacles with the carriage through the opening in the housing an automated arm having an end adapted to engage the trash receptacle. In another embodiment, the method includes the steps of engaging plural trash receptacles with the carriage simultaneously. In another embodiment the method includes the step of advancing the carriage through plural positions within the enclosure. In a specific embodiment, the foregoing embodiment includes the steps of impinging rinse-water against the trash receptacle, and accumulating rinse-water drainage in a second basin. In yet another embodiment, the method includes the further step of drying the trash receptacle.

DESCRIPTION OF THE INVENTION

Figure 1:
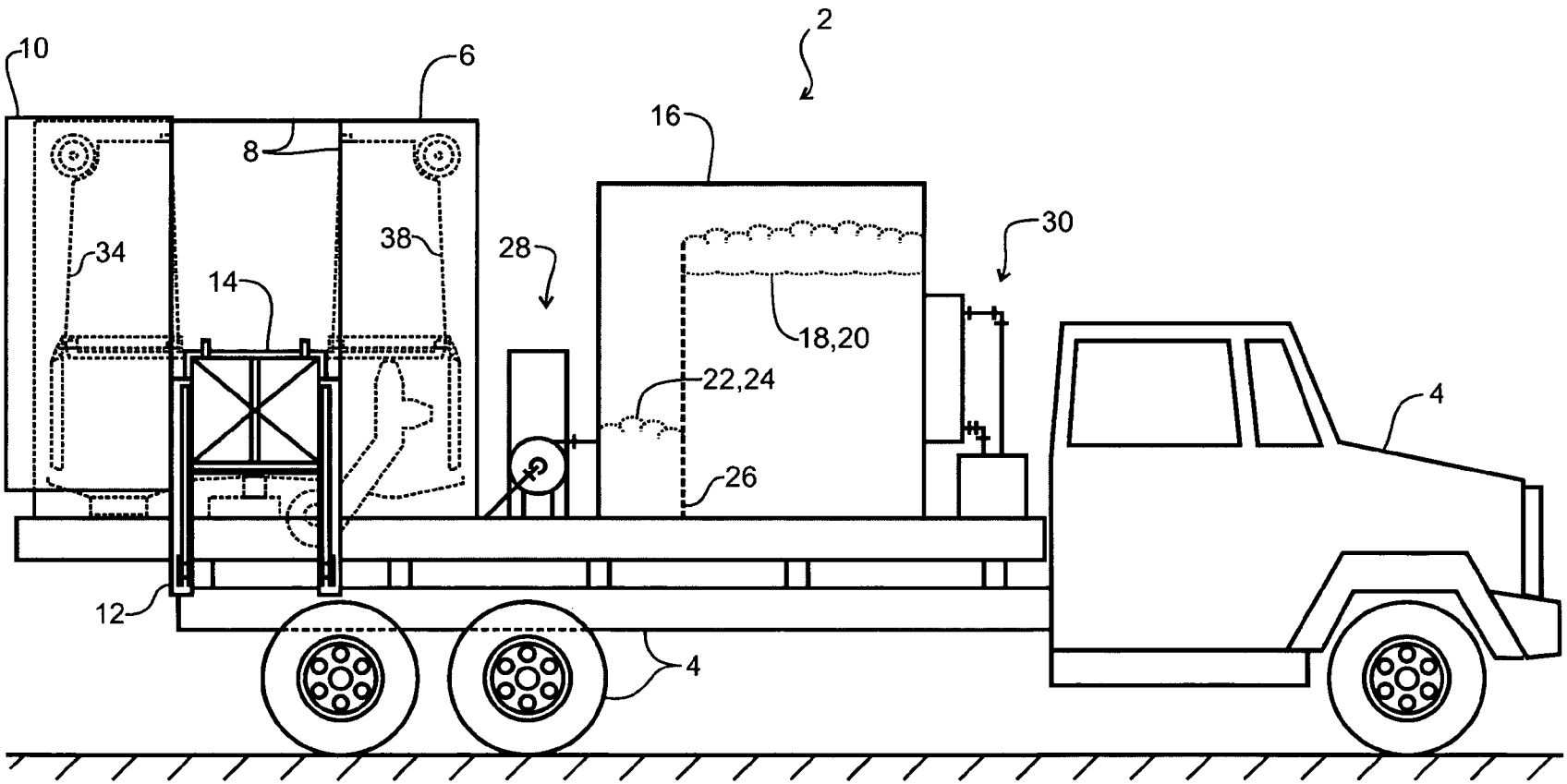
FIG. 1 is a side view drawing of a mobile trash receptacle cleaning system according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods and components to form various apparatus. Accordingly, the apparatus components and method steps have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

The present invention advances the art by providing systems and methods that enable mobile cleaning of trash and recycling receptacles (hereinafter, collectively "trash receptacles") utilizing wash-water, and optionally, rinse-water that are captured, recycled, and sanitized during use or prior to ultimate disposal. This approach provides the benefit of maintaining cleaner trash receptacles while at the same time preventing pollution and environmental damage through improper disposal of wastewater. Various configurations of the systems and method are contemplated, including various sanitation technologies. Illustrative embodiments are now presented.

Reference is directed to FIG. 1, which is a side view drawing of a mobile trash receptacle cleaning system 2 according to an illustrative embodiment of the present invention. The cleaning system 2 is disposed on a vehicle 4, which is a flatbed truck in the illustrative embodiment, although any suitable vehicle could readily be utilized. The cleaning system comprises several major systems, including a wash enclosure 6 with a wash carriage 14 therein, a wash-water and rinse-water tank system, a water pumping system 28 and a water sanitizing system 30. The wash enclosure 6 has an access opening 8 formed on the curbside of the truck 4, which provides an access point for inserting and removing trash receptacles 34, 38 from the wash carriage 14 located within the enclosure 6. A sliding door 10 is provided, which is transitioned between an open position that allows insertion and removal of the trash receptacles, and a closed position, where the door 10 acts as a spray shield that reduces wash-water effluence from the enclosure. During operation, the carriage 14 is rotated to advance the trash receptacles 34, 38 through various stations in the cleaning process. In the illustrative embodiment, an automated arm 12 is provided, which engages the trash receptacles and inserts and removes them through opening 8. Further details regarding the automated arm 12 are presented hereinafter.

The trash receptacle washing process employs wash-water, and optionally may employ rinse-water. In the illustrative embodiment, a multi-chamber water tank 16 provides storage for an adequate water supply to enable operation of the system over the course of a typical cleaning work shift, such as an eight-hour shift. A water supply of approximately four hundred gallons is suitable for a typical eight-hour residential cleaning shift. Although, any reasonable quantity of water may be stored, as dictated by the rate at which trash receptacles are cleaned and by the type of sanitization process employed. The water tank 16 includes a wash-water chamber 18 and a rinse-water chamber 20. The illustrative embodiment sanitization system employs an ozonation process that produces wash-water rinse-water foam in the respective chamber 18, 20. The tank 16 is compartmentalized using an internal partition 26, which acts as an overflow weir so that foam generated during the sanitization process spills into a wash-water foam chamber 22 and the rinse-water foam chamber 24. The partition 26 may include a manually operated, or automated, gate (not shown) along the top edge, which allows controlled transfer of foam from the storage chambers 18, 20 to the foam chambers 22, 24.

Figure 2:
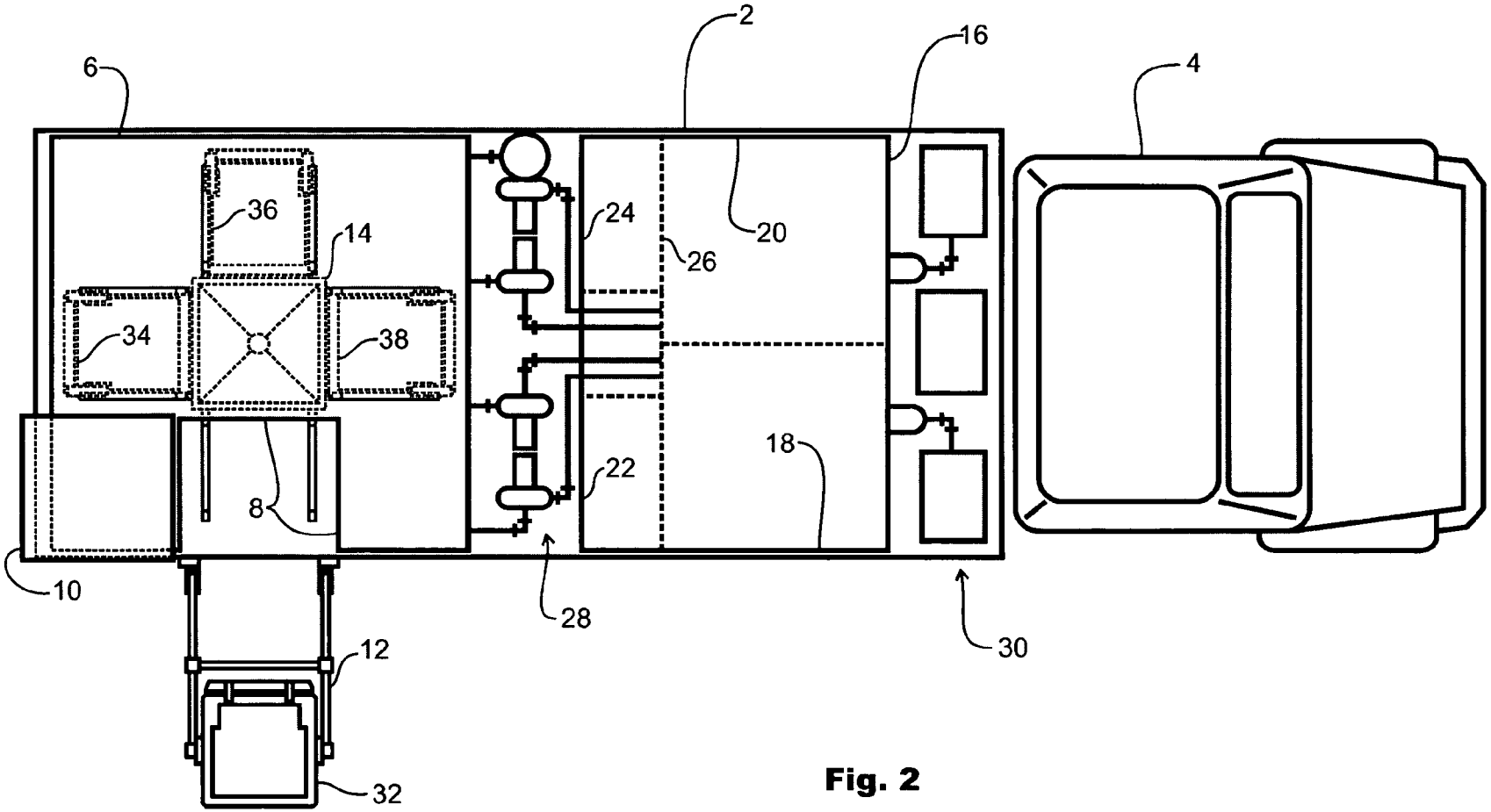
FIG. 2 is a top view drawing of a mobile trash receptacle cleaning system according to an illustrative embodiment of the present invention.

Reference is directed to FIG. 2, which is a top view drawing of the mobile trash receptacle cleaning system 2 according to the illustrative embodiment of the present invention. The flat bed truck 4 supports the wash enclosure 6, which has the wash carriage 14 located therein. In the illustrative embodiment, the enclosure 6 is fabricated from lightweight steel plate, although any suitable material known to those skilled in the art, which prevents the effluence of wash-water, can be employed. The opening 8 in the enclosure 6 extends up the curbside of the enclosure and over a portion of the top of the enclosure 6. This arrangement provides ample clearance so that the automated arm 12 can engages a trash receptacle 32, rotate it to an inverted position, and transition it so as to engage the carriage 14 within the enclosure 6. Further details of this arrangement will be provided hereinafter. The sliding door 10 is shown retracted to the open position. This drawing view illustrated four trash receptacles. The first trash receptacle 32 is in position to be inserted through opening 8 to engage the carriage 14. The other three trash receptacles 34, 36, and 38 are shown engaged with carriage 14 in three cleaning locations within the enclosure, which include a wash position, a rinse position and a drying position in the illustrative embodiment.

FIG. 2 also illustrates the arrangement of the various chambers in the water tank 16. The wash-water chamber 18 is aligned with its corresponding foam chamber 22. The rinse-water chamber 20 is aligned with its corresponding foam chamber 24. The water and foam chambers are separated by internal partition 26. Note that this chamber arrangement is configured to address the foam generation issue present in the illustrative embodiment ozonation sanitization process, and would be different if a chemical based sanitation process were employed. Chemical based sanitation processes include the use of sanitizing agents, soap, detergents, surfactants, bleach, chlorine, or many other sanitizing agents known to those skilled in the art. A series of pumps 28 and filters are used to circulate the wash-water, rinse-water and effluent between the tanks, basins, and the wash enclosure, as will be more fully described hereinafter. The ozonation sanitizing system 30 is located adjacent to the tank 16 in the illustrative embodiment. Note that the physical arrangement of the components in the illustrative embodiment cleaning system is completely flexible, as a design choice. Other embodiments of the trash receptacle systems can be envisioned that place the enclosure, tanks, pumps and sanitizing systems at other location about the vehicle, and which are dependent upon the physical arrangement and load and size limitations of the vehicle. These are merely design choices that fall within the scope of the present invention. In addition, it is contemplated that a reserve tank of clean water may be provided so that the wash-water and rinse-water tanks can be refilled as the supplies are diminished during operation of the system.

Figure 3:
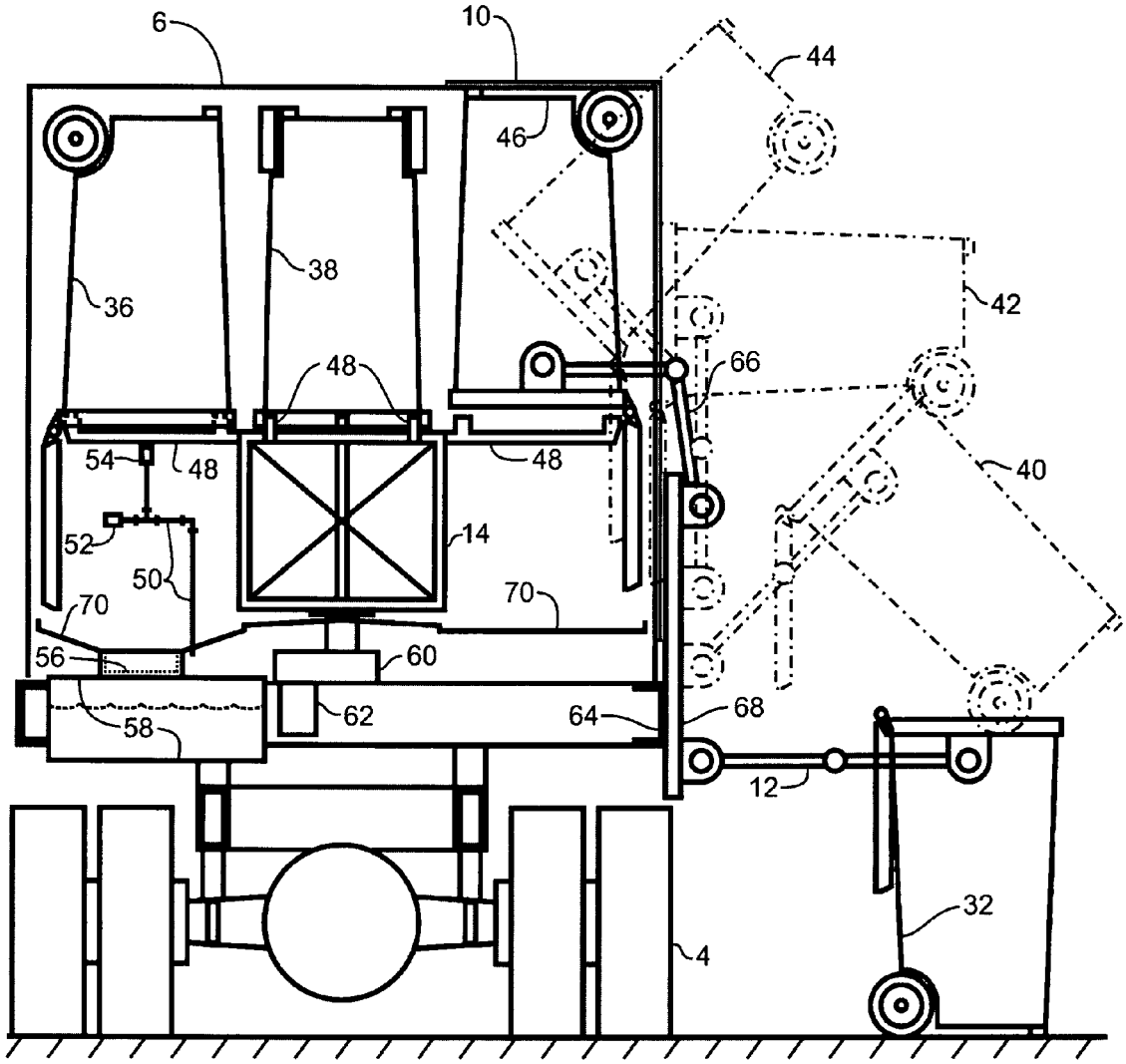
FIG. 3 is an end view section drawing of a mobile trash receptacle cleaning system according to an illustrative embodiment of the present invention.

Reference is directed to FIG. 3, which is an end view section drawing of the mobile trash receptacle cleaning system according to an illustrative embodiment of the present invention. This view illustrates the wash enclosure 6 from the back of the truck 4, as a section view just inside the wash enclosure. The truck 4 axle is shown for reference. The cleaning system frame 64 is mounted on the truck frame and supports the other components of the illustrative embodiment cleaning system. The spray shield door 10 is shown, and note that the door covers the side and a portion of the top of the enclosure 6. The aforementioned automated arm 12 is configured to engage a trash receptacle 32, which has been left on the curb by a consumer. The door 10 is automated in the illustrative embodiment and its operation is coordinated and interlocked with that of the automated arm 12. It is known to those skilled in the trash collection arts that trash receptacles and automated arms are cooperatively developed to allow automated collection of trash, and a similar design configuration is employed in the illustrative embodiment. The automated arm is coupled to the enclosure using at linear track 68. In operation, the automated arm is aligned along the curb with the trash receptacle 32. The arm 12 engages the receptacle and begins to rotate upward as the arms connection point also traverse upwardly along the linear track 68. This combined movement of the arm is illustrated by phantom lines 40 and 42. Once the arm reaches the vertical position 42, an articulated portion of the arm 66 begins to rotate as shown at location 44. The trash receptacle is fully inverted at position 46 and is lowered onto the engagement arm 48 of the carriage 14. Note that there are four sets of engagement arms 48 on the carriage 14. Trash receptacles 36 and 38 are at separate locations on the carriage 14.

In FIG. 3, the trash receptacle at location 46 is at the load and unload position of the carriage 14. Receptacle 36 is at the rinse position and receptacle 38 is at the drying position. The wash position is not visible in this section view, but is illustrated hereinafter in FIG. 5. The carriage 14 in FIG. 2 is supported on a bearing and reduction gear housing 60, which are driven by a motor 62, together which accomplish the rotation of the carriage so as to advance the receptacles from position to position during the cleaning process. A floor 70 is disposed within the enclosure 6, and acts to collect the effluent from the washing and rinsing processes. The floor 70 is sloped to drain and collected the effluent, as will be more fully discussed hereinafter. Trash receptacle 34 is in the rinse position. A set of spray nozzles 52, 54 are support and fed using a pipe structure 50. The nozzles are aligned to fully rinse the surfaces of the trash receptacle 34. While two nozzles 52, 54 are illustrated, it is to be understood that plural nozzles, both inside and out of the trash receptacle, can be employed to fully rinse the entire thrash receptacle 34, including the inside and outside if desired. The effluent from the rinse process is collected by a sloped section of the floor 70, which drains into a basin 58 through mesh filter 56. The filter 56 catches any course debris and is readily accessible by the operator of the system for cleaning from time to time during a work shift. The washing and drying position of the carriage and enclosure will be discussed hereinafter.

Figure 4:
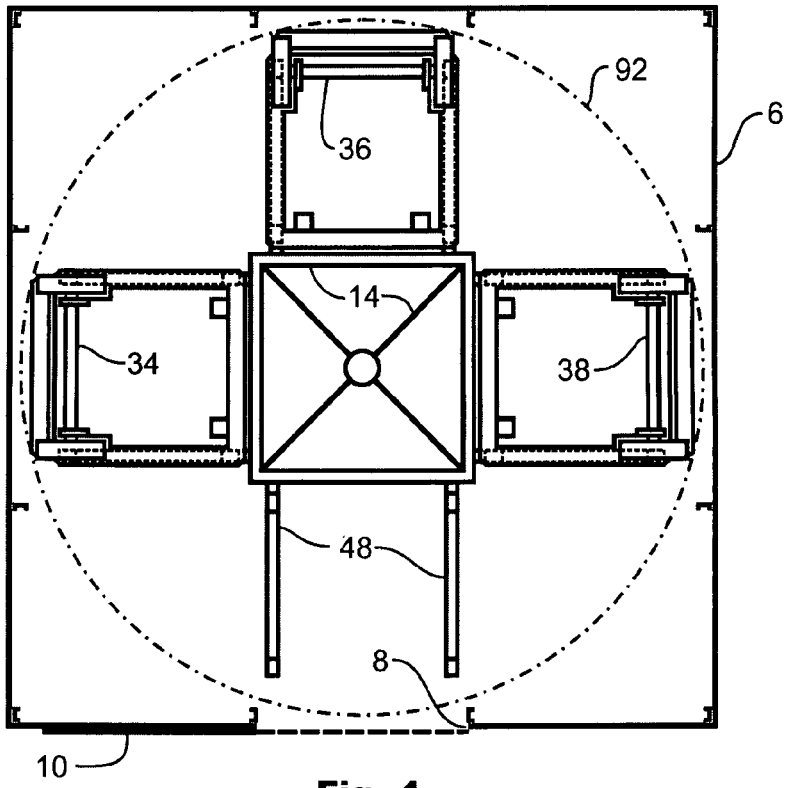
FIG. 4 is a top view drawing of a cleaning enclosure and carriage according to an illustrative embodiment of the present invention.

Reference is directed to FIG. 4, which is a top view drawing of the cleaning enclosure 6 and carriage 14 according to the illustrative embodiment of the present invention. The enclosure 6 is formed from lightweight steel plate supported by light steel channels about its interior periphery. The carriage 14 and support arms 48 rotate together with the trash receptacles 34, 36, 38. Phantom line circle 92 illustrates the arc of rotation of the carriage assembly. The spray shield door 10 opens and closes about opening 8 to prevent drainage of effluent from the interior of the enclosure 6. Note that the opening 8 and door 10 are an exemplary embodiment of a spray shield. The system requires an access opening to insert and remove the trash receptacles. The spray shield serves the function of retaining the majority of the spray in the system, thereby greatly reducing the effluent of wash-water and rinse-water from the system. This function serves to increase efficiency of the water utilization of the system as well as reducing undesirable emissions of pollutants from the system. The spray shield can be configured in a variety of ways to accomplish these objectives. Any type of door known to those skilled in the art could be employed, including plural spray shield wings, which is similar to the way that a revolving door operates.

Figure 5:
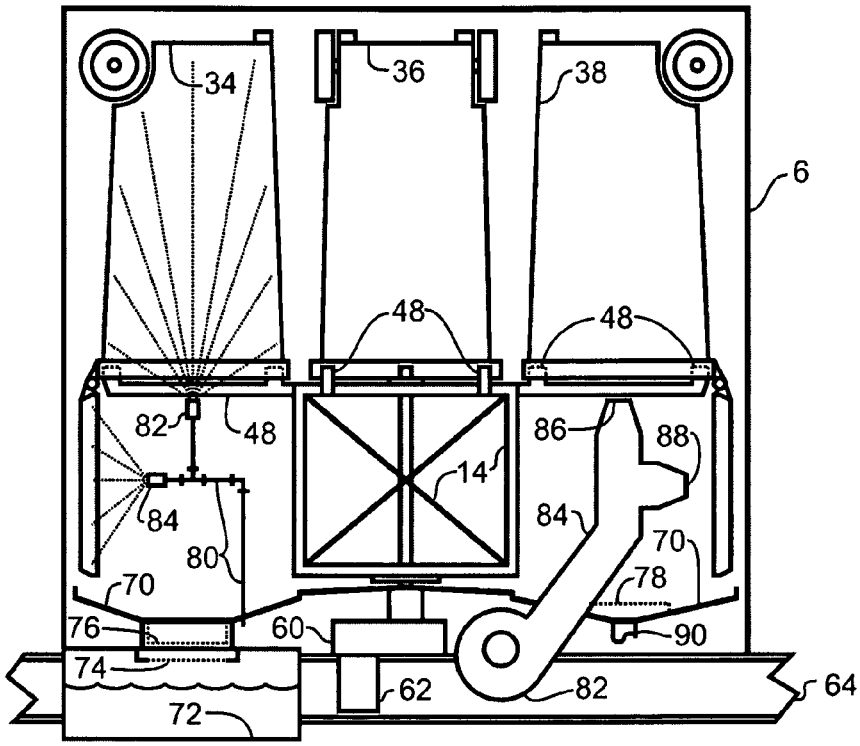
FIG. 5 is a side view section drawing of a cleaning enclosure and carriage according to an illustrative embodiment of the present invention.

Reference is directed to FIG. 5, which is a side view section drawing of a cleaning enclosure 6 and carriage 14 according to the illustrative embodiment of the present invention. The cleaning system frame 64 is illustrated, which supports the gear reduction bearing 60 and motor 62 assembly discussed above. In FIG. 5, trash receptacle 34, supported on the carriage 14 by support arms 48, is shown in the wash position. Wash spray nozzles 82, 84 are supported on wash-water feed pipe assembly 80. The spray heads are aligned to impinge wash-water onto the trash receptacle 34. While two spray heads 82, 84 are illustrated in the illustrative embodiment, it is to be understood that plural spray nozzles, directed to the inside and outside of the trash receptacle can be employed to achieve the degree of wash action required. The design is dependent upon the nature of the wash-water and cleaning chemicals used, as well as the pressure and volume of wash-water, and the duration of the wash cycle. These are design choices based on the intended result required by the process. The wash-water effluent falls to the floor 70, which is sloped to drain the effluent through a basket strainer 76 and a mesh filter into a catch basin 72. The basket filter 76 is configured to catch course debris and is readily serviceable by the operator of the system to be emptied of debris from time to time during a work shift, as required.

In FIG. 5, trash receptacle 38 is shown in the drying position of the carriage 14 in the enclosure 6. A centrifugal fan 82 is energized to force ambient air through air ducts 84 and out of air nozzles 86, 88, which serve to dry the trash receptacle 38. A small amount of effluent will be blown off of the receptacle 38 during the drying operations. This effluent is collected by the sloped floor 70 and exits through a drain opening, which is routed to the rinse-water basin illustrated in FIG. 3. In FIG. 5, the drain opening 90 is covered with a mesh filter to prevent any loose debris from clogging the drain 90.

Figure 6:
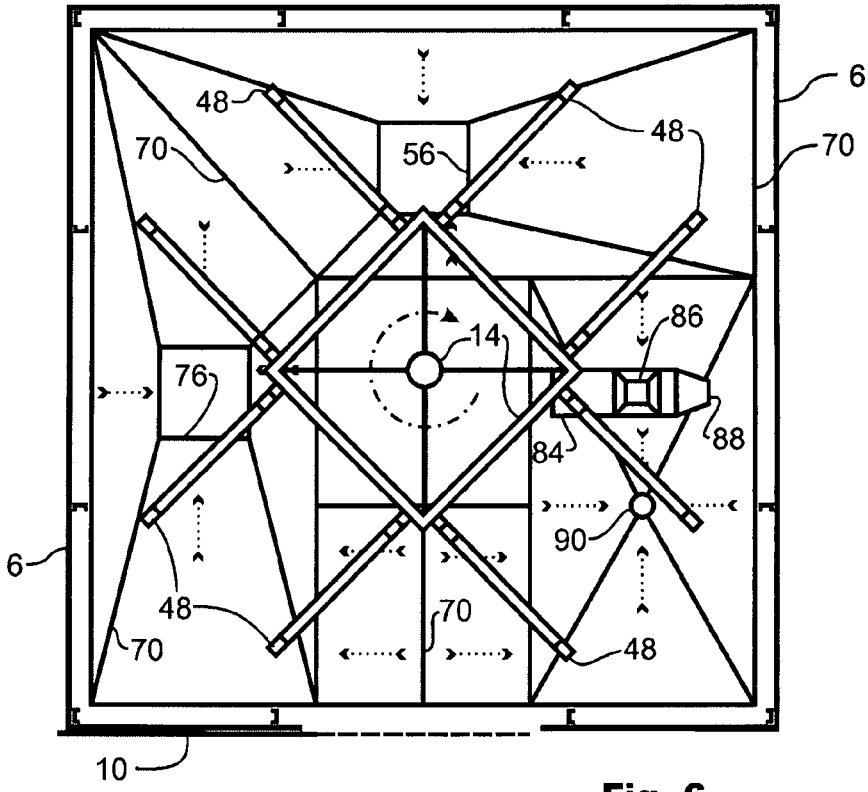
FIG. 6 is a floor plan drawing of a cleaning enclosure and carriage according to an illustrative embodiment of the present invention.

Reference is directed to FIG. 6, which is a floor plan drawing of a cleaning enclosure and carriage according to an illustrative embodiment of the present invention. The enclosure 6 is illustrated with the floor 70 plan shown to illustrate the various slopes that serve to direct the effluent wash-water to the wash-water basin 76 and the rinse-water basin 56, as well as the drying station drain 90. The dotted-line arrows illustrated the direction of the various slopes toward the basins and drain. The drying duct 84 and drying nozzles 86 and 88 are also illustrated. The carriage 14 and trash receptacle support arms 48 are illustrated as rotated halfway between the fixed station positions. Note that a small amount of mixing of the effluent between the wash-water circuit and the rinse-water circuit is acceptable in the illustrative embodiment because both water circuits include a sanitization loop. In other embodiments, spray shields between the wash, rinse and dry stations can be employed.

Figure 7:
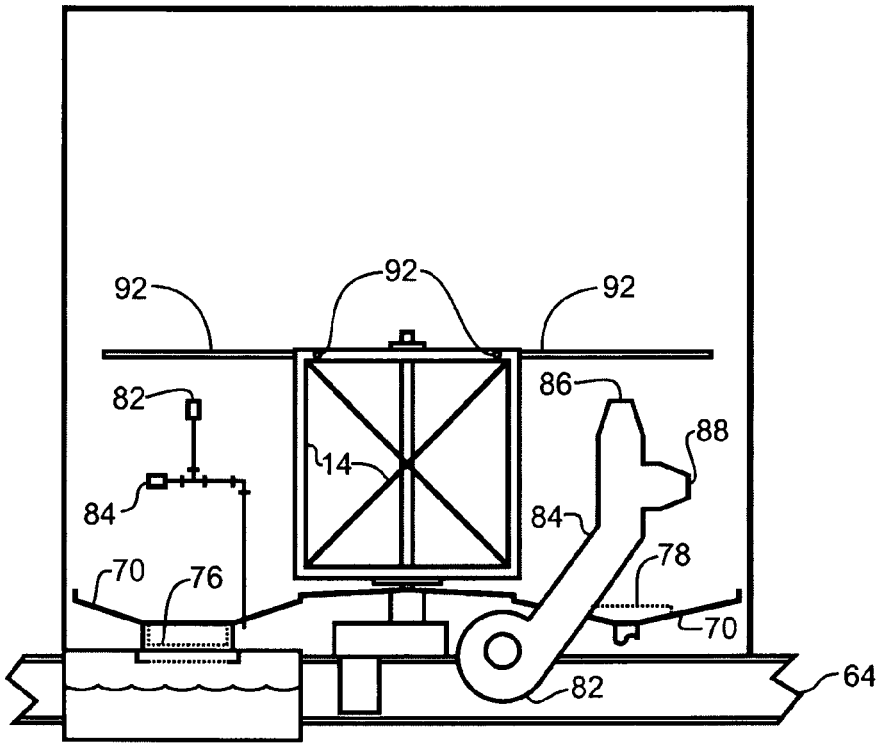
FIG. 7 is a side view drawing of a cleaning enclosure and carriage according to an illustrative embodiment of the present invention.
Figure 8:
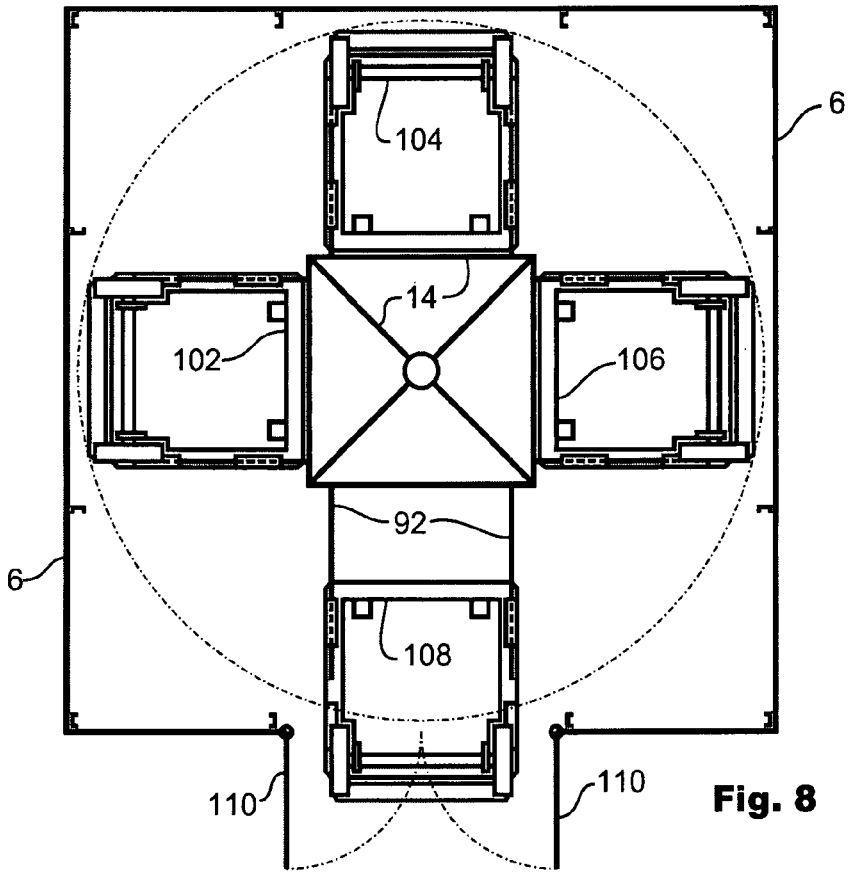
FIG. 8 is a top view drawing of a cleaning enclosure and carriage according to an illustrative embodiment of the present invention.

Reference is directed to FIG. 7, which is a side view drawing of a cleaning enclosure and carriage according to an illustrative embodiment of the present invention. The embodiment of FIG. 7 is the same as that of FIG. 5, except that the carriage 14 support arms are different, which have been replaced with support rods 92. The other elements in FIG. 7 follow the description from FIG. 5, which will not be repeated. The support rods are adapted for manual insertion and removal of the trash receptacles from the enclosure, rather than an automated arm of the previous embodiment. Attention is directed to FIG. 8 for a further discussion of the manually loaded cleaning system.

Figure 9:
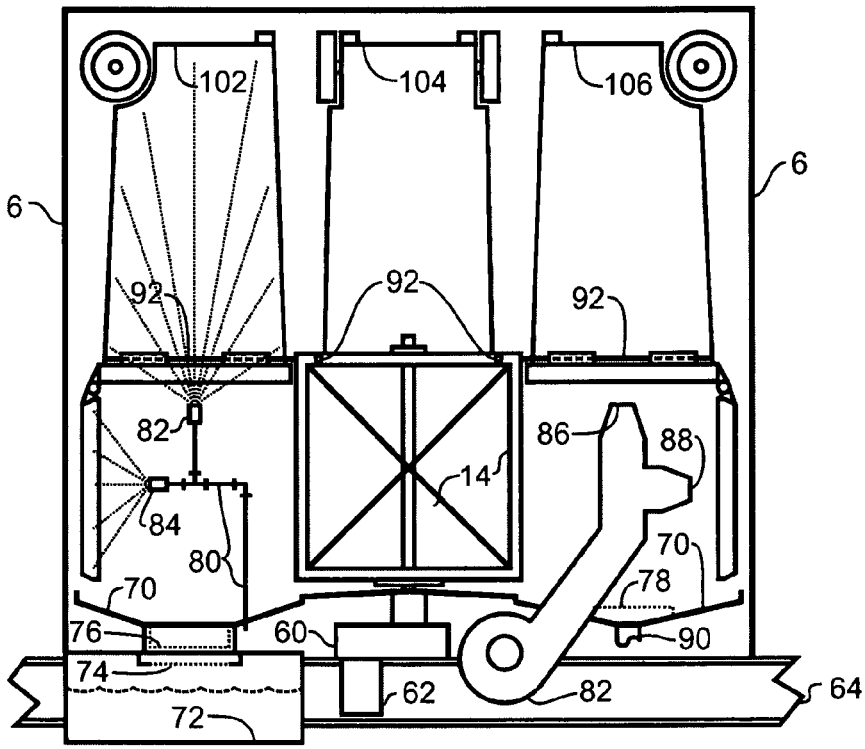
FIG. 9 is a side view section drawing of a cleaning enclosure and carriage according to an illustrative embodiment of the present invention.

Reference is directed to FIG. 8, which is a top view drawing of a cleaning enclosure 6 and carriage 14 according to an alternative illustrative embodiment of the present invention. The access opening of this illustrative embodiment is controlled using one or two hinged doors 10, which are manually operated by the operator of the cleaning system. The support rods 92 are fixed to carriage 14 and configured to engage support slots formed in the trash receptacles 102, 104, 106, 108. In operation, the operator opens the door 110, lifts, inverts, and slides the trash receptacle 108 onto the support rods 92, then advances the carriage to effect the first stage of the cleaning operation. The dried container 106 is thereby advanced to the door 110 position, so that the operator can readily remove the receptacle and replace it to curb side. FIG. 9 is a side view section drawing of the cleaning enclosure 6 and carriage 14 according to the alternative illustrative embodiment of the present invention. Again, the various nozzle, basin, support and drying components are the same as discussed in FIG. 5, and will not be repeated. Note that the support rods 92 engage slots formed into the trash receptacles 102, 104, 106. Those skilled in the art will appreciate that the carriage support arms can readily be configured to engage any particular trash receptacle, or can be configured to engage unknown types of trash receptacles. For example, the support arms could have a coarse mesh surface connected across them so that any type of receptacle can be inverted and rested thereupon. The coarse mesh allows the spray and effluent to pass freely. Those skilled in the art will appreciate that many different support systems can be adapted to the carriage of the present invention.

Figure 10:
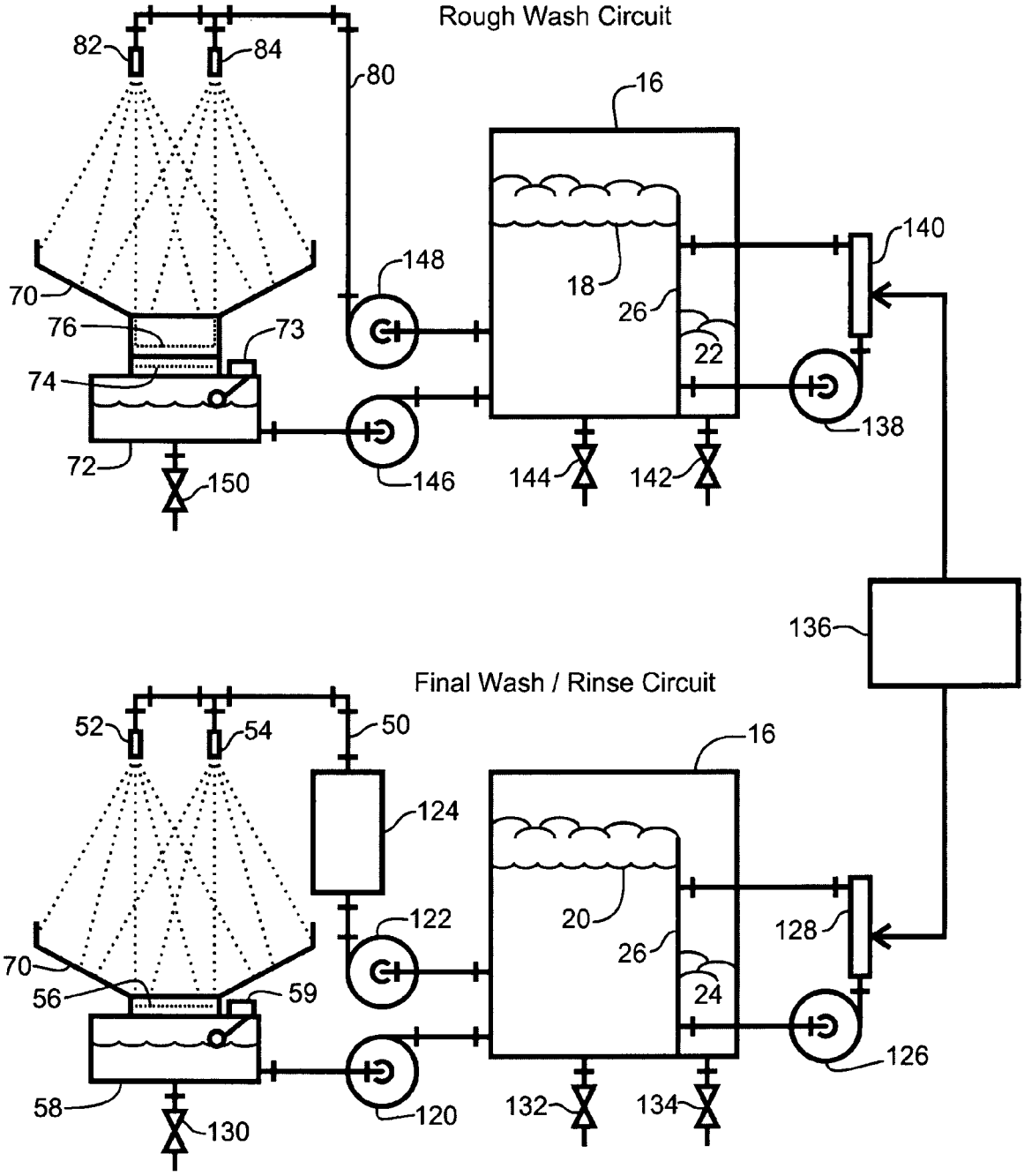
FIG. 10 is a water circulation drawing of a mobile trash receptacle cleaning system and method according to an illustrative embodiment of the present invention.

Reference is directed to FIG. 10, which is a fluid circuit drawing of a mobile trash receptacle cleaning system and method according to an illustrative embodiment of the present invention. The drawing is divided into an upper circuit that comprises the rough wash circuit and a lower circuit that comprises the final wash, or rinse, circuit. With respect to the rough wash circuit, the wash-water chamber 18 of the wash-water tank 16 is separated from the foam chamber 22 by divider panel 26. As foam is produced it spills over the divider 26 into the foam holding chamber 22. The wash-water chamber 18 has a drain valve 144 that is used to empty the tank 16 at the end of each work shift. Similarly, the foam chamber 22 has a drain valve 142. The wash-water is drawn from the tank 18 by wash-water pump 148, which is coupled to the spray nozzles 82, 84 supply pipes 80, so as to impinge wash-water on the trash receptacle (not shown). The sloped floor 70 collects the effluent wash-water and directs it toward the basket strainer 76, and then through mesh filter 74. The effluent accumulates in basin 72. A float switch 73 is coupled to an effluent pump drive circuit (not shown), which energizes the effluent pump 146 to transfer the effluent back to the wash-water tank 18, where the continual sanitation process occurs. Note that further filtering, such as by fine mesh or centrifugal filters can be added, depending on the degree of clarity is desired in the wash-water. A drain valve 150 is provided in the effluent basin 72 for complete draining at the end of each shift.

In the illustrative embodiment, the wash-water and rinse-water are sanitized using an ozonation unit produced by Con-Serv Manufacturing, located in Lakeland Fla. A recirculation pump 138 runs continuously drawing water from the wash-water tank 18 and forces it through an ozone injector 140 where ozone and dry air are injected into the stream of water. Immediately the ozone starts to react with the organic and inorganic materials in the wash-water. This reaction continues as the water is transferred back into the wash-water tank 18. The ozone reacts with the oils, waxes, dyes and solvents to de-emulsify these materials where they are removed from the water, forming floating dry dirty foam at the surface. This foam then overflows to the foam holding tank 22. The ozone reacts with the organic materials by oxidation. Bacterial cells are killed and turned into a globule materials, which are easily captured by the filtration provided in the circulation loop, or which may simply settle to the bottom of tank 18. Killing the bacteria cell prohibits the accumulation of odor associated with effluent wash-water. The ozone reacts with the inorganic materials in the water by chemical oxidation reactions, which generally turn these materials into an inert oxide chemical form, which either settles out of the water or is caught in loop filtration.

With respect to the final wash, or rinse-water, circuit in FIG. 10, the rinse-water chamber 20 of the wash-water tank 16 is separated from the foam chamber 24 by divider panel 26. As foam is produced it spills over the divider 26 into the foam holding chamber 24. The wash-water chamber 20 has a drain valve 132 that is used to empty the tank 16 at the end of each work shift. Similarly, the foam chamber 24 has a drain valve 134. The rinse-water is drawn from the tank 20 by rinse-water pump 122. The water is forced through a fine particulate filter 124, which is coupled to the spray nozzles 52, 54 supply pipes 50, so as to impinge wash-water on the trash receptacle (not shown). The particulate filter 124 serves to remove any noticeable solids from the rinse-water stream, which yields a good finish to the dried trash receptacle (not shown). The tapered floor 70 collects the effluent rinse-water and directs it through mesh filter 56. The effluent accumulates in basin 58. A float switch 59 is coupled to an effluent pump drive circuit (not shown), which energizes the effluent pump 120 to transfer the effluent back to the rinse-water tank 20, where the continual sanitation process occurs. Note that further filtering, such as by fine mesh or centrifugal filters can be added, depending on the degree of clarity is desired in the rinse-water. A drain valve 130 is provided in the effluent basin 58 for complete draining at the end of each shift. The continual sanitization process consists of a recirculation pump 126 that runs continuously drawing water from the rinse-water tank 20 and forces it through an ozone injector 128 where ozone and dry air are injected into the stream of water. The rinse-water circuit shares the same ozone generator 136 with the wash-water circuit.

Figure 11:
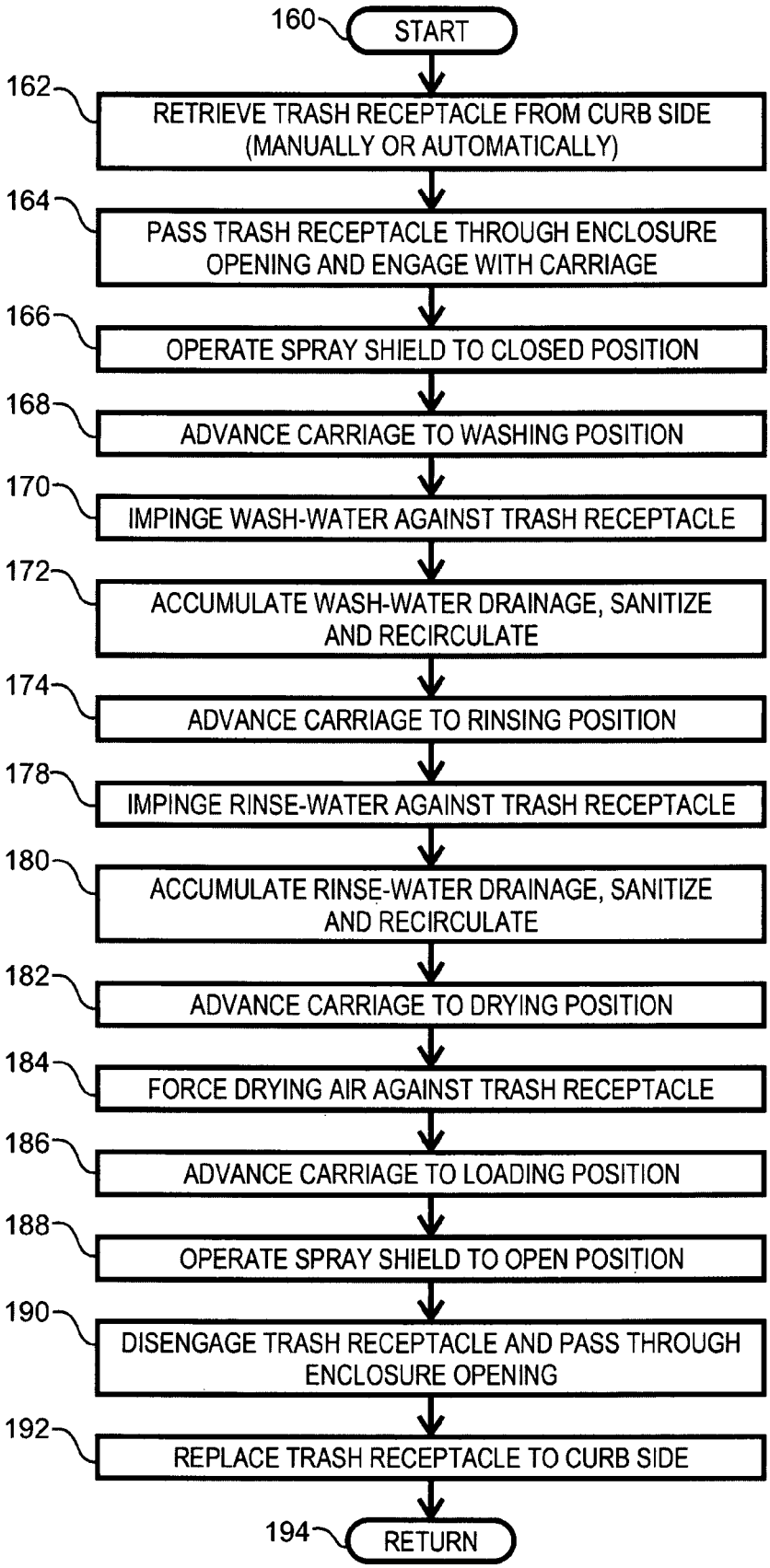
FIG. 11 is a process flow diagram for a mobile trash receptacle cleaning system and method according to an illustrative embodiment of the present invention.

The operation of the cleaning system of the illustrative embodiments is managed by a programmable industrial controller as are known to those skilled in the art. The coordination of the spray shield and automatic arm are thereby coordinated. So too is the rotation of the carriage and the duration of each wash, rinse and dry cycle. The pumps and fan are similarly energized and deenergized by the programmable controller. Thusly, the designer and operator of the systems of the illustrative embodiment are enabled to tailor the operation of the system to meet sanitation, cost, time, and other system constraints. FIG. 11 is a process flow diagram that represents one illustrative embodiment of such a tailored system.

Reference is directed to FIG. 11, which is a process flow diagram for a mobile trash receptacle cleaning system and method according to an illustrative embodiment of the present invention. The process begins at step 160 and proceeds to step 162 where a trash receptacle is retrieved from curbside, either manually or by the automated arm. At step 164, the trash receptacle is passed through the opening the cleaning enclosure and engaged with the support arm of the carriage. At step 166, the spray shield is operated to the closed, or protective, position. At step 168, the carriage is advanced so that the new trash receptacle is put in the wash position. At step 170, the wash-water pump is started, which causes wash water to impinge against the trash receptacle. At step 172, the wash-water effluent drainage is accumulated in the basin, recirculated to the wash-water tank, and sanitized through the ozonation loop. At step 174, the carriage is advanced to place the trash receptacle at the rinse position. At step 178, the rinse-water pump is started, which causes rinse-water to impinge against the trash receptacle. At step 180, the rinse-water effluent drainage is accumulated in the basin, recirculated to the rinse-water tank, and sanitized through the ozonation loop. At step 182, the carriage is advanced to place the trash receptacle at the drying position. At step 184, the fan is energized to force drying air against the trash receptacle. At step 186, the carriage is advanced to the load/unload position. At step 188, the spray shield is operated to enable removal of the trash receptacle from the cleaning enclosure. At step 190, the trash receptacle is removed from the enclosure. At step 192, the cleaned trash receptacle is replaced at the curbside. The process is this complete and returns at step 194.

It will be appreciated that embodiments of the present invention described herein may be comprised of one or more conventional processors and unique stored program instructions that control the one or more processors to implement, in conjunction with certain non-processor circuits, some, most, or all of the functions described herein. The non-processor circuits may include, but are not limited to, a radio receiver, a radio transmitter, signal drivers, clock circuits, power source circuits, and user input devices. As such, these functions may be interpreted as steps of a method. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used. Thus, methods and means for these functions have been described herein. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A vehicle mountable system for cleaning trash receptacles with wash-water, comprising:

an enclosure, configured to prevent the effluence of wash-water therefrom, having an access opening, configured to enable the insertion of the trash receptacles there through, supported on the vehicle;

a carriage, the entirety of which is disposed within said enclosure;

a spray head aligned to impinge wash-water against the trash receptacle while engaged with said carriage;

a basin located within said enclosure and aligned to accumulate wash-water drainage, and a spray shield operable to a closed position that closes said access opening and prevents wash-water effluence from said access opening in said enclosure by completing the enclosure thereof.

2. The system of claim 1, further comprising:

a means for sanitizing wash-water accumulated by said basin.

3. The system of claim 2, and wherein said means for sanitizing is a wash-water tank having an ozonation recirculation loop.

4. The system of claim 2, and wherein said means for sanitizing is a chemical additive.

5. The system of claim 1, further comprising:

a filter coupled to remove particulate from the wash-water.

6. The system of claim 1, further comprising:

a holding tank containing a volume of wash-water sufficient for cleaning a plurality of trash receptacles, and a pump coupled in a wash-water circuit consisting of said holding tank, said spray head, and said basin, thereby recirculating the wash-water.

7. The system of claim 1, further comprising:

an automated arm having a first end fixed relative to said enclosure and a second end adapted to engage a trash receptacle, and wherein said automated arm operates to engage and disengage the trash receptacle with said carriage through said access opening.

8. The system of claim 1, and wherein said carriage is configured to engage plural trash receptacles simultaneously.

9. The system of claim 8, and wherein said carriage advances the plural trash receptacles through plural positions within said enclosure.

10. The system of claim 1, further comprising:

a second spray head aligned to impinge rinse-water against the trash receptacle, and a second basin for accumulating rinse-water drainage.

11. The system of claim 1, further comprising:

a trash receptacle drying means disposed within said enclosure.

12. A method of cleaning trash receptacles with wash-water in a vehicle mountable system, while preventing the effluence of wash-water, comprising the steps of:

engaging a trash receptacle with a carriage through an access opening in an enclosure, wherein the entirety of the carriage is disposed within the enclosure, and the enclosure is configured to prevent the effluence of wash-water therefrom;

operating a spray shield to a closed position that closes the access opening and prevents wash-water effluence from the access opening in the enclosure by completing the enclosure thereof;

impinging wash-water against the trash receptacle, and accumulating wash-water drainage in a basin.

13. The method of claim 12, further comprising the step of:

sanitizing the wash-water accumulated by the basin by using a chemical additive.

14. The method of claim 12, further comprising the step of:

sanitizing the wash-water accumulated by the basin using a wash-water tank having an ozonation recirculation loop.

15. The method of claim 12, further comprising the steps of:

filtering particulate matter from the accumulated wash-water, and recirculating filtered wash-water to said spraying step.

16. The method of claim 12, further comprising the steps of:

engaging and disengaging the trash receptacles with the carrier through the opening in the housing an automated arm having an end adapted to engage the trash receptacle.

17. The method of claim 12, further comprising the steps of:

engaging plural trash receptacles with the carriage simultaneously.

18. The method of claim 17, further comprising the step of:

advancing the carriage through plural positions within the enclosure.

19. The method of claim 12, further comprising the steps of:

impinging rinse-water against the trash receptacle, and accumulating rinse-water drainage in a second basin.

20. The method of claim 12, further comprising the step of:

drying the trash receptacle.

* * * * *